US008292706B2

(12) United States Patent
Møller et al.

(10) Patent No.: US 8,292,706 B2
(45) Date of Patent: Oct. 23, 2012

(54) ROOF LIGHT SYSTEM HAVING A VENTILATION DEVICE WITH IMPROVED FLEXIBILITY

(75) Inventors: Brent Møller, Gentofte (DK); Per Jacobsen, Horsens (DK); Niels A. Larsen, Frederiksberg (DK); James Eric Brinton, Greenwood, SC (US); Leonard Kenneth Moody, Jr., Eagan, MN (US)

(73) Assignee: VKR Holding A/S, Hoersholm (DK)

( * ) Notice: Subject to any disclaimer, the term of this patent is extended or adjusted under 35 U.S.C. 154(b) by 1260 days.

(21) Appl. No.: 11/814,532

(22) PCT Filed: Jan. 24, 2005

(86) PCT No.: PCT/DK2005/000045
§ 371 (c)(1),
(2), (4) Date: Jul. 23, 2007

(87) PCT Pub. No.: WO2006/076914
PCT Pub. Date: Jul. 27, 2006

(65) Prior Publication Data
US 2008/0207108 A1 Aug. 28, 2008

(51) Int. Cl.
*E04D 13/03* (2006.01)
*F24F 7/00* (2006.01)
*E04B 7/18* (2006.01)

(52) U.S. Cl. ..... 454/199; 454/339; 52/200

(58) Field of Classification Search ..... 454/199, 454/339; 52/200
See application file for complete search history.

(56) References Cited

U.S. PATENT DOCUMENTS

| | | | | |
|---|---|---|---|---|
| 2,885,948 | A | 5/1959 | Oshins | |
| 3,064,548 | A | 11/1962 | Field | |
| 3,085,490 | A | 4/1963 | Field | |
| 3,839,949 | A * | 10/1974 | Gobel | 454/199 |
| 5,099,622 | A | 3/1992 | Sutton et al. | |
| 5,117,811 | A * | 6/1992 | Taylor | 126/623 |
| 5,435,780 | A | 7/1995 | Ayles | |
| 5,502,935 | A * | 4/1996 | Demmer | 52/200 |
| 5,535,559 | A * | 7/1996 | Nielsen et al. | 52/199 |
| 6,142,645 | A * | 11/2000 | Han | 362/147 |
| 6,695,692 | B1 * | 2/2004 | York | 454/199 |
| 6,918,216 | B2 * | 7/2005 | Hoy et al. | 52/200 |
| 6,990,773 | B2 * | 1/2006 | Borges | 52/200 |
| 7,104,014 | B2 * | 9/2006 | Skuse et al. | 52/200 |
| 7,234,279 | B2 * | 6/2007 | Sincic et al. | 52/200 |
| 7,875,252 | B2 * | 1/2011 | Ma et al. | 422/186.3 |

FOREIGN PATENT DOCUMENTS

CN 1844788 A * 10/2006

* cited by examiner

*Primary Examiner* — Steven B McAllister
*Assistant Examiner* — Frances H Kamps
(74) *Attorney, Agent, or Firm* — Turner Padget Graham & Laney, PA

(57) ABSTRACT

The roof light system is composed by a roof unit (10), a light conduit (70) and a diffuser unit (80). A ventilation device has a ventilation tube (60) is separate and detached from the light conduit (70). The first end (60*a*) of the ventilation tube is connected with the roof unit (10) and the second end (60*b*) is positioned at a distance from the diffuser unit (80). The ventilation device may additionally have a branch tube (160).

19 Claims, 9 Drawing Sheets

ROOF LIGHT SYSTEM HAVING A VENTILATION DEVICE WITH IMPROVED FLEXIBILITY

RELATED APPLICATIONS

The present application claims the benefit of International Application Number PCT/DK2005/000045, entitled, "Roof Light System Having A Ventilations Device With Improved Flexibility," filed Jan. 24, 2005.

FIELD OF THE INVENTION

The present invention relates to a roof light system comprising a roof unit, a light conduit and a diffuser unit, said light conduit having a first cross-section and a first length and extending between the roof unit and the diffuser unit, the roof light system furthermore comprising a ventilation device including a ventilation tube having a second cross-section and a second length extending between a first end and a second end.

BACKGROUND OF THE INVENTION

Traditionally, roof units such as roof windows, skylights and other more or less light transmissible roof penetrating structures provide natural lighting to a space situated immediately below or only a short unobstructed distance from the part of the roof, in which the roof unit is installed. For illuminating other spaces such as rooms situated further inwards and/or downwards with respect to the roof of the building, artificial lighting has been the dominating source of light.

For many reasons, natural lighting may be desirable in a room. In order to provide lighting or supplement artificial lighting of an inner room, roof window assemblies of the kind mentioned in the introduction have been suggested and are well known in the art. In such an assembly, a light conduit is led through the roof structure between the roof unit installed in the roof and a diffuser unit installed in the ceiling of an inner room. Light from the ambience is channelled through the light conduit into the inner room. The light conduit may e.g. be formed as a length of flexible hose, possibly reinforced by wire hoops, or rigid sections connected with each other to form the desired path of the light conduit between the roof unit and the diffuser unit. In order to ensure that as much natural lighting as possible is channelled from the outside to the inner room, the internal side of the light conduit is usually provided with a light reflective lining or coating, or the entire material of the light conduit is made from a light reflective material.

In some fields of application, ventilation of the inner room is desirable or even required, as is e.g. the case in a bathroom. In order to allow moist air to escape from the inner room and fresh air from the outside to enter the room, ventilation means leading from the room to the roof may be provided.

In its simplest form such ventilation means is in the form of apertures in the diffuser unit and the roof unit, respectively. Air is thus allowed to flow inside the light conduit itself. Examples of prior art making use of this type of arrangement are U.S. Pat. No. 5,435,780 and published international application No. WO 02/25032. However, problems of condensation may arise as the warm humid air from the inner room enters the light conduit and is transported in the direction of the roof unit. Furthermore, the apertures in the roof unit, although usually formed in concealed positions, entail a risk of entry of precipitation.

In order to alleviate the problems with condensation in the light conduit, one example of a solution is represented by U.S. Pat. No. 6,142,645, in which a separate venting duct is provided. The venting duct is coupled to the diffuser unit at the ceiling of the inner room and is led to an aperture in the roof adjacent the skylight itself. Although this design makes it possible to let moist air flow outside the light conduit, an additional aperture must be formed in the roof, which is not desirable from i.a. an aesthetic point of view.

A further development of this concept is known, in which a second tube surrounds a first tube constituting the light conduit. Ventilation is carried out in the space defined by the inner wall of the second tube and the outer wall of the first tube. Although this solution might be satisfactory in use, it is necessary to install the entire system simultaneously as subsequent installation of the second tube is, in most cases, impossible. Furthermore, ventilation is confined to the area adjacent the light conduit, as the inner end of the second tube necessarily ends at the inner end of the light conduit.

With this background it is an object of the present invention to provide a roof light system of the kind mentioned in the introduction, in which the risk of condensation is eliminated, which is at the same time easy to install, and by which a higher degree of flexibility with respect to ventilation conditions is achieved.

This and further objects are met by a roof light system of the kind mentioned in the introduction, which is furthermore characterized in that said at least one ventilation tube is separate from the light conduit, said second cross-section being detached from said first cross-section, and that said first end of the ventilation tube is connected with the roof unit and said second end is positioned at a distance from the diffuser unit.

SUMMARY OF THE INVENTION

By the provision of a separate ventilation tube, which is nevertheless connected with the roof unit, the problem inherent with arrangements making use of the light conduit itself as ventilation passage is completely avoided. At the same time, the provision of an additional opening in the roof is made redundant. As the respective cross-sections of the light conduit and the ventilation tube are detached from each other and do thus not overlap, the ventilation device is not dependent on the remaining parts of the roof light system. It is thus possible to install the ventilation device independently of the roof light system. Eventually, as the second end of the ventilation tube is positioned at a distance from the diffuser, it is possible to provide ventilation in areas where ventilation is most needed, but where it is not strictly necessary with a light source. For instance, the second end of the ventilation tube may be installed above a shower positioned e.g. in a corner of a bathroom and the diffuser at a central position of the bathroom.

In order to obtain an ever higher degree of flexibility, the ventilation device may comprise, in addition to said ventilation tube, a branch tube extending between a first end and a second end. The second end of the branch tube may be positioned at a distance from the second end of the ventilation tube and from the diffuser unit.

Additionally, the ventilation device may comprise a second branch tube extending between a first end and a second end. The second end of the second branch tube may in this case be connected with the diffuser unit.

In a preferred embodiment, the ventilation tube is connected with the frame by means of a manifold member. The function of the manifold member is to allow passage from the ventilation tube and possibly the branch tube or tubes to the roof unit and further out to the surroundings.

The manifold member may be an integral part of the roof unit or separate therefrom. The use of a separate manifold member facilitates installation and makes it possible to after-mount the ventilation tube on an already installed roof unit not beforehand provided with a ventilation device. In an embodiment, in which the roof unit comprises a frame and a sash carrying a glazing, the manifold member is a separate member connected with the frame. In an advantageous further development of this embodiment, the manifold member is substantially U-shaped and surrounds the light conduit partly.

Preferably, the second end of the second branch tube is connected with the diffuser unit by means of a manifold member.

In order to facilitate the installation procedure even further, a development of this preferred embodiment is characterized in that the manifold member is releasably connected with the frame or diffuser unit by means of a set of flaps on the manifold member cooperating with apertures in the frame or the diffuser unit. Preferably, these apertures are provided as knock-out plates surrounded by detachment indication lines. Supplemental connection means, such as screw or snap engagement means, may be provided.

The manifold member may comprise a series of openings surrounded by upstanding walls. In this manner, water collected in the manifold member as a result of entered precipitation or condensation from humid air is prevented from flowing into the ventilation tube.

In order to support natural ventilation, means for mechanical ventilation may be provided.

Due to its position in a roof the roof unit may be utilized for the application of solar cells. Such solar cells may be positioned on any part of the roof unit.

In case it is desired to make the entrance to the light conduit inconspicuous, a reflective and/or coloured film or coating may be provided on the frame and/or the glazing.

In an embodiment, which is particularly advantageous with respect to manufacture and installation, a base module including the roof unit, the light conduit, the diffuser unit and the ventilation device is provided. At least the roof unit and the light conduit include interchangeable elements.

With the base module, a functional roof light system is achieved. In case it is desired to supplement the base module with optional elements, this may be accomplished by interchanging one or more elements of the base module with additional elements. For instance, the base module of the roof light system may be transformed into a more traditional, openable roof window.

The shape of the roof unit and the cross-sectional shape of the light conduit may in principle be arbitrary. For instance, the shapes may match, i.e. a circular light conduit connected with a circular roof unit, or a rectangular roof unit with a rectangular light conduit. In a preferred embodiment, the roof unit includes a frame having a circular aperture and a sash, said frame and sash having a rectangular shape, preferably square.

In this manner, the roof light system according to the invention may be built-in in a roof, in which traditional roof windows are installed, without breaking the uniform appearance of e.g. a row of roof windows and roof units.

The circular shape of the aperture in the frame entails a number of advantages as regards the installation of the roof light system. As a consequence of the particular shape, a ring may be provided for connection with a rim surrounding said aperture, said ring being provided with pins for engagement with lugs on the rim. In order to improve the retention of the light conduit on the ring, the ring may be provided with a circumferential flange, the light conduit being connected with the ring by means of a draw-band positioned above said flange.

BRIEF DESCRIPTION OF THE DRAWINGS

In the following the invention will be described in further detail with reference to preferred embodiments and to the schematic drawings.

DETAILED DESCRIPTION OF PREFERRED EMBODIMENTS

Figure 1:
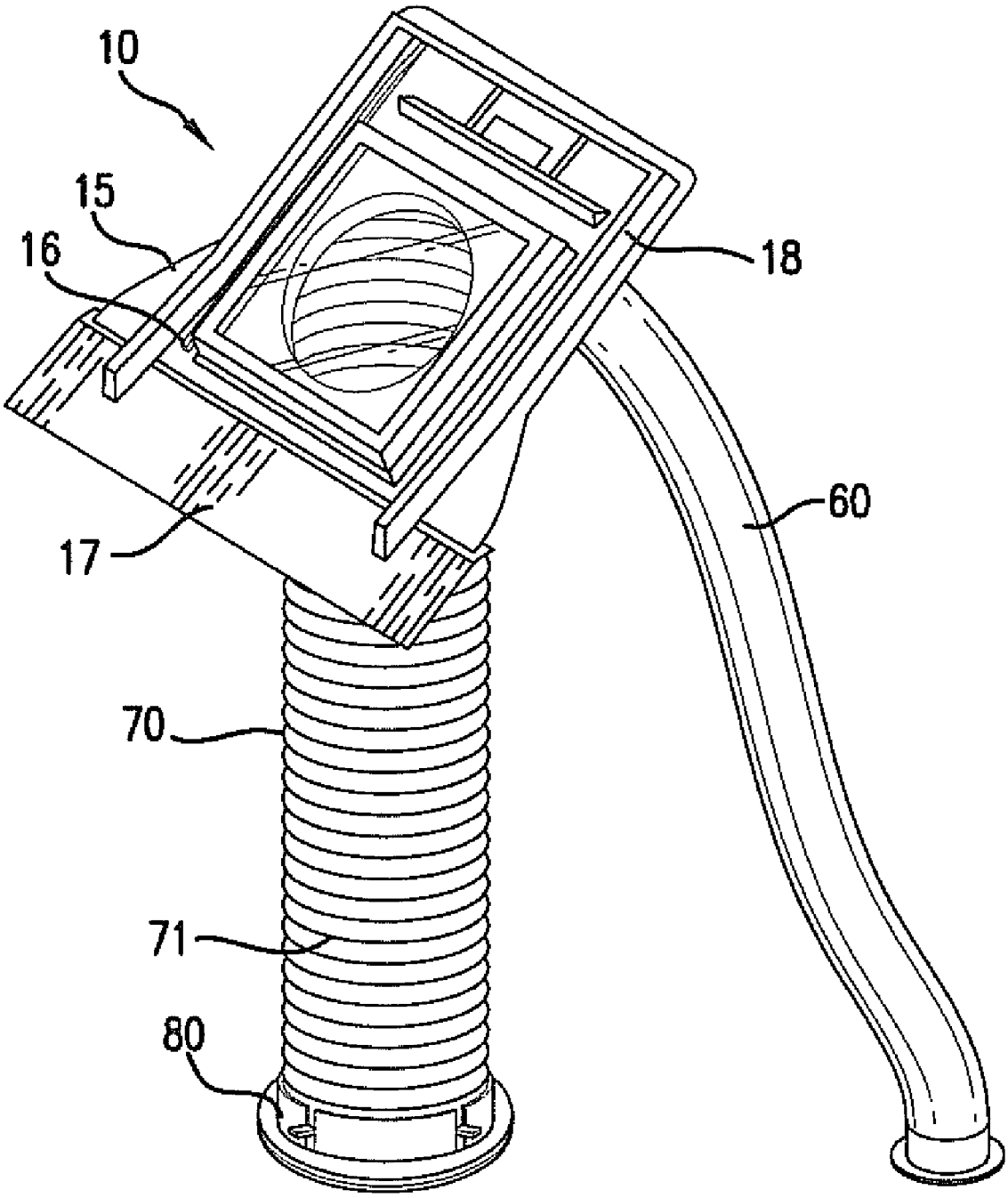
FIG. 1 shows a perspective view of a roof light system in an embodiment of the present invention.

Referring to the drawings, the roof light system comprises a roof unit 10, a light conduit 70 and a diffuser unit 80.

Figure 10:
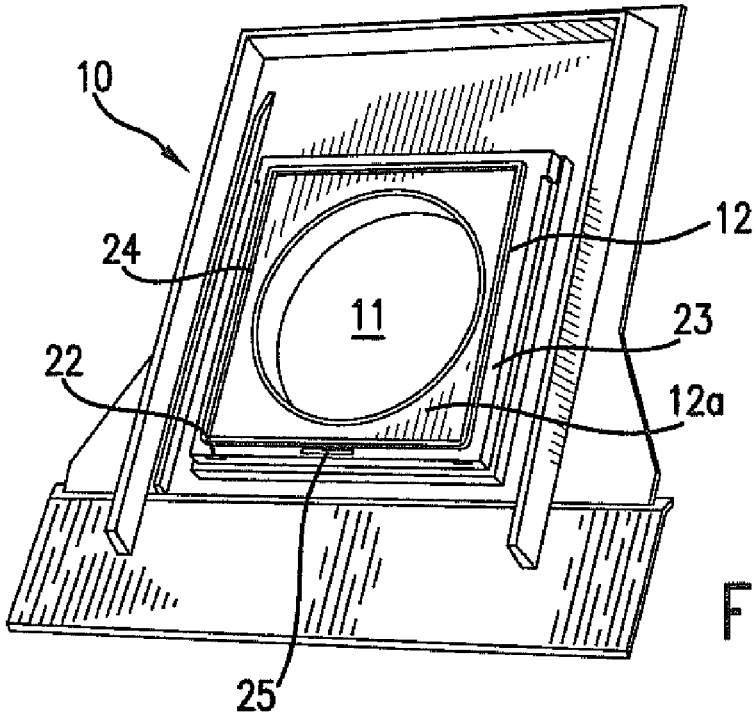
FIG. 10 is a partial perspective view of a detail of the roof light system.

The roof unit 10 is intended to be installed in the roof of a building and includes a light-admitting aperture 11 formed in a frame 12, cf. FIG. 10. Light is admitted into the aperture 11 through a sash 13 carrying a glazing 14, cf. in particular FIG. 6. The glazing 14 may be formed in any suitable manner and from any suitable translucent material, e.g. glass or a plastic material. Roof unit 10 furthermore comprises a flashing arrangement intended to provide a substantially weather-tight transition to the surrounding roofing (not shown). In the embodiment shown, the frame 12 is formed integrally with substantially sheet-shaped portion 15 surrounding the frame 12. The sheet-shaped portion is, in the mounted position, placed substantially beneath the roofing. In order to direct precipitation on to a skirt portion 17 placed on top of the roofing, rails 16 are provided on either side of the frame 12. Furthermore, a sealing strip 18 is connected with the sheet-shaped portion 15 and the skirt portion 17 to prevent water from entering the underlying roof structure. The flashing arrangement may also be provided separately from the frame and sash, or be dispensed with altogether, if the installation conditions allow so.

Opposite the aperture 11 in the frame 12 of roof unit 10, one end of the light conduit 70 is connected with the frame 12 in a manner which will be described in detail further on. The light conduit 70 has a first cross-section and a first length which corresponds to or exceeds the distance between the roof unit 10 and the diffuser unit 80. The other end of the light conduit 70 is connected with the diffuser unit 80, likewise to be described in detail further on. The diffuser unit 80 is intended to be installed in the ceiling of an inner room in the building, and light conduit 70 thus extends through at least the roof structure of the building. In the embodiment shown, light conduit 70 is formed as a length of flexible hose reinforced by wire hoops 71. However, the light conduit may be formed by rigid sections connected with each other to form the desired path of the light conduit between the roof unit and the diffuser unit. Furthermore, the light conduit may have any suitable cross-sectional dimension and be of arbitrary shape. In order to ensure that as much natural lighting as possible is channeled from the outside to the inner room, the internal side of the light conduit is usually provided with a light reflective finishing, such as lining or coating, or the entire material of the light conduit is made from a light reflective material.

Eventually, a ventilation device is provided for allowing moist air to escape from the inner room and fresh air from the outside to enter the room. The ventilation device comprises a ventilation tube 60, which may be formed from any suitable, preferably flexible, material and may have any cross-sectional shape. The ventilation tube 60 has a second cross-section and a second length extending between a first end 60*a* and a second end 60*b*. As is the case with the light conduit 70, the second length corresponds to or exceeds the distance between the roof unit 10 and ceiling in which the second end 60*b* is to be installed. In the first end 60*a* the ventilation tube 60 is connected with the roof unit 10. In a preferred embodiment to be described further on, this connection is carried out by means of a manifold member 40 and a mouth piece 61 on the ventilation tube 60. In the second end 60*b*, at a distance from the diffuser unit 80, the ventilation tube 60*b* has a mouth piece 62 for connection to the ceiling.

As the ventilation tube 60 is separate from the light conduit 70 and the cross-section of the ventilation tube 60 is detached from, i.e. does not overlap at any point, the cross-section of the light conduit 70, the ventilation device may be installed independently of the other parts of the roof light system. It is furthermore noted that the respective cross-sections may vary over the length of the light conduit and the ventilation tube, respectively. The cross-sections may, as indicated in the drawings, be entirely different. The respective lengths and courses of the light conduit 70 and the ventilation tube 60 may vary as well, e.g. to adapt to installation conditions.

Figure 2:
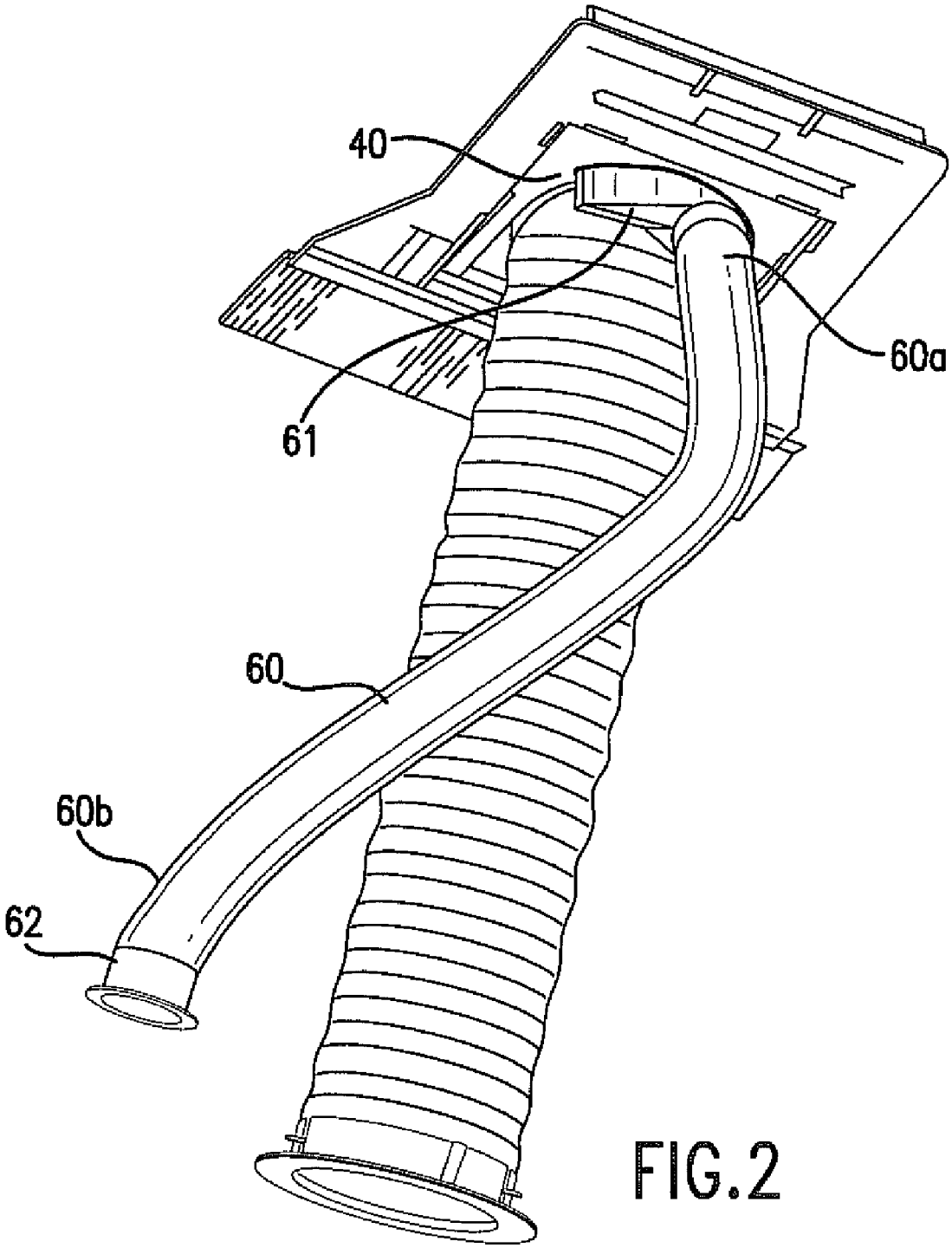
FIG. 2 is a view corresponding to FIG. 1 of a first embodiment of the roof light system shown from the side intended to face inwards into a building.
Figure 3:
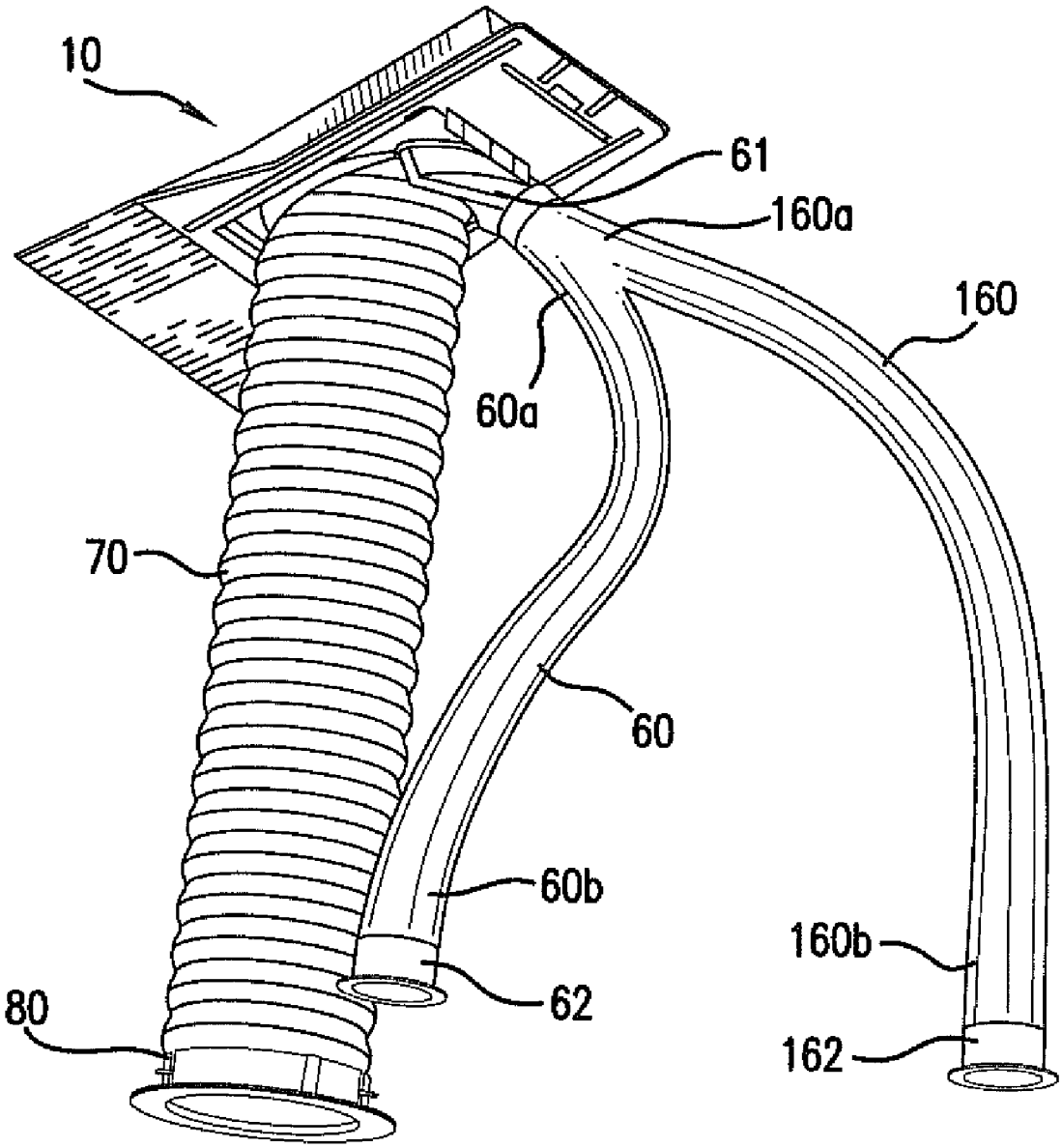
FIG. 3 is a view corresponding to FIG. 2 of a second embodiment of the roof light system shown from the side intended to face inwards into a building.

In FIG. 3 an alternative embodiment is shown. Only differences with respect to the embodiment of FIGS. 1 and 2 will be described in detail. This embodiment provides for an ever higher degree of flexibility with respect to the possibilities of obtaining ventilation in different, spaced-apart areas. In addition to the ventilation tube 60, a branch tube 160 is provided. The branch tube 160 extends between a first end 160*a* and a second end 160*b*. The first end 160*a* is positioned at the branch-off from the ventilation tube 60, between the first 60*a* and second 60*b* ends of the ventilation tube 60. In the embodiment shown, the branch-off is situated virtually at the first end 60*a* of the ventilation tube 60. One manner of obtaining this configuration is to cut the ventilation tube 60 and the branch tube 160 obliquely, connect part of the circumferences and let the two tubes merge into the mouth piece 61. As indicated in FIG. 3 the second end 160*b* of the branch tube 160 is positioned at a distance from the second end 60*b* of the ventilation tube 60 and from the diffuser unit 80. At the second end 160*b*, the branch tube 160 has a mouth piece 162 which might be the same as mouth piece 62 or different.

Figure 4:
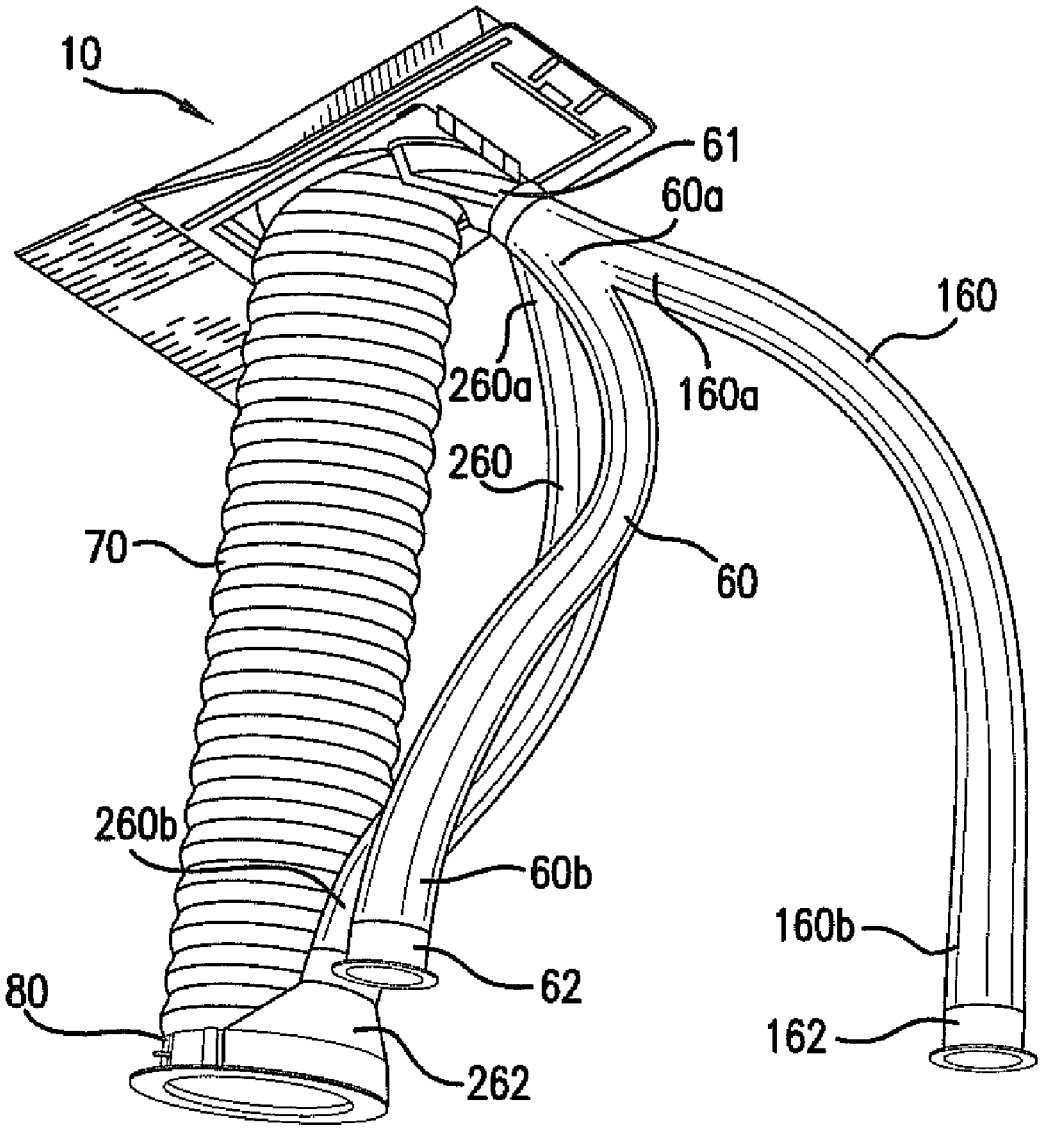
FIG. 4 is a view corresponding to FIG. 2 of a third embodiment of the roof light system shown from the side intended to face inwards into a building.

In FIG. 4, a further development is shown. In addition to the ventilation tube 60 and the branch tube 160 of the embodiment of FIG. 3, the ventilation device comprises a second branch tube 260 extending between a first end 260*a* and a second end 260*b*. In the embodiment shown, the first end 260*a* is positioned between the first 60*a* and second 60*b* ends of the ventilation tube 60, i.e. the second branch tube 260 is branched off from the ventilation tube 60 near its first end 60*a*. It is of course conceivable to let the second branch tube 260 branch off from the branch tube 160, or to position the branch-off site arbitrarily along the ventilation tube 60 or the branch tube 160. Alternatives as indicated in the above description of the FIG. 3 embodiment may of course be incorporated as well. In the embodiment shown, the second end 260*b* of the second branch tube 260 is connected with the diffuser unit 80 by means of a mouth piece 262.

In order to support the natural draft in the ventilation tube 60, means for providing mechanical ventilation may be present in the ventilation device. Such means are known per se and may e.g. include an electrically operated fan. The fan or fans may be positioned arbitrarily in the ventilation device, e.g. in the roof unit or at the mouth piece 62, 162 and/or 262. It may be advantageous to position a fan at the intended branch-off site or sites on the ventilation tube 60. In this case, the fan may be provided with two or more inlet ends, possibly covered by knock-out plates, and one outlet end facing the first end 60*a* of the ventilation tube 60.

Details regarding the connection between the light conduit 70 and the ventilation tube 60, and the roof unit 10 will be described with particular reference to FIGS. 5 to 9.

One particularly advantageous manner of installing the roof light system according to the present invention comprises the following steps:

The roof unit 10 is mounted in an aperture in the roof prepared to that purpose. Attachment of the roof unit may be performed in any suitable manners known per se from skylights, roof windows and other roof penetrating structures, comprising e.g. the use of mounting brackets secured to the underlying roof structure in the form of rafters and laths, or sheathing. Roofing is placed on top of the sheet-shaped portion 15 of the flashing arrangement up to a suitable distance from the frame 12 and sash 13 of the roof unit, and the skirt portion 17 is made to abut against the upper face of the roofing below the frame 12 and sash 13.

Figure 5:
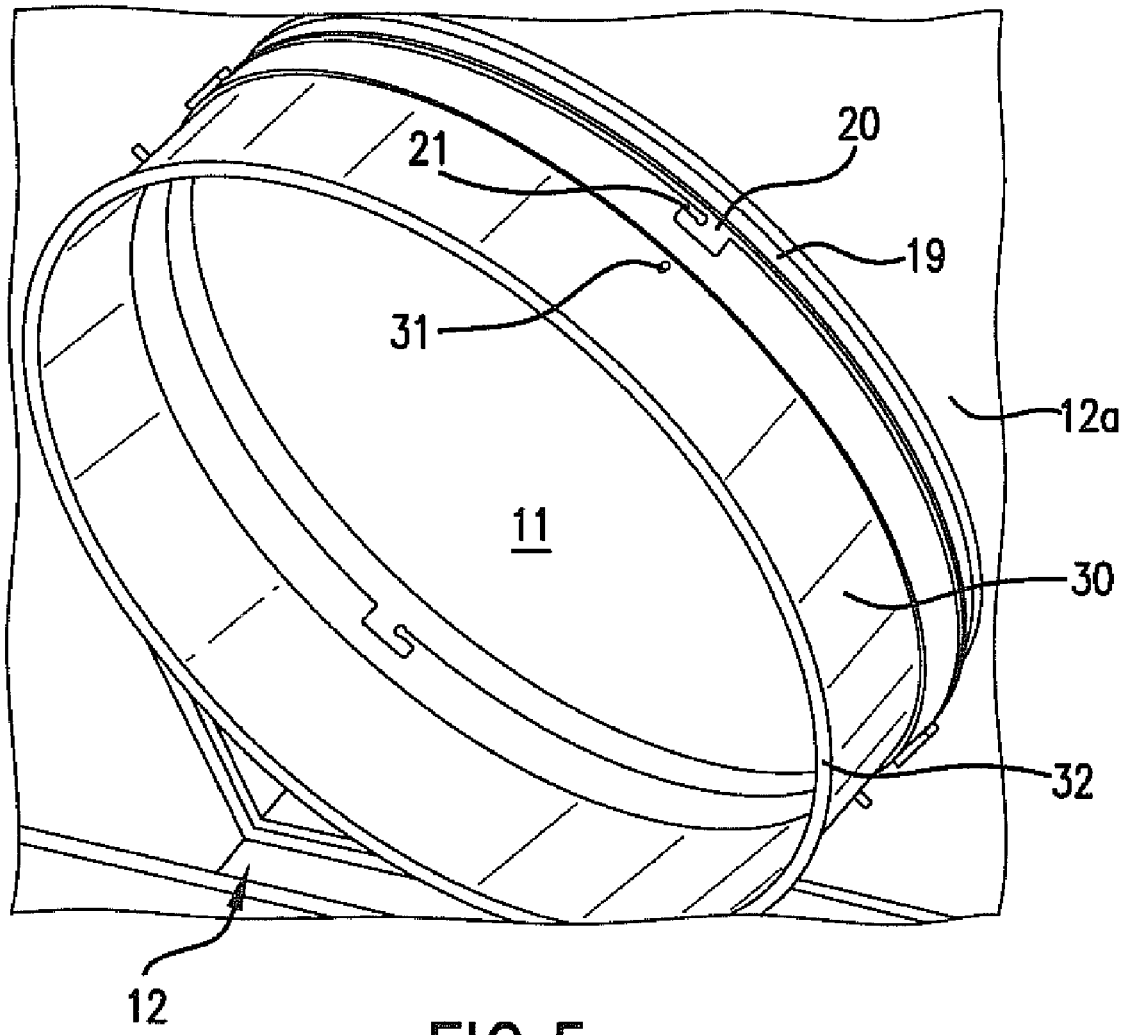
FIG. 5 shows, on a larger scale, a perspective view of a detail of the roof light system shown in FIGS. 1 and 2.
Figure 6:
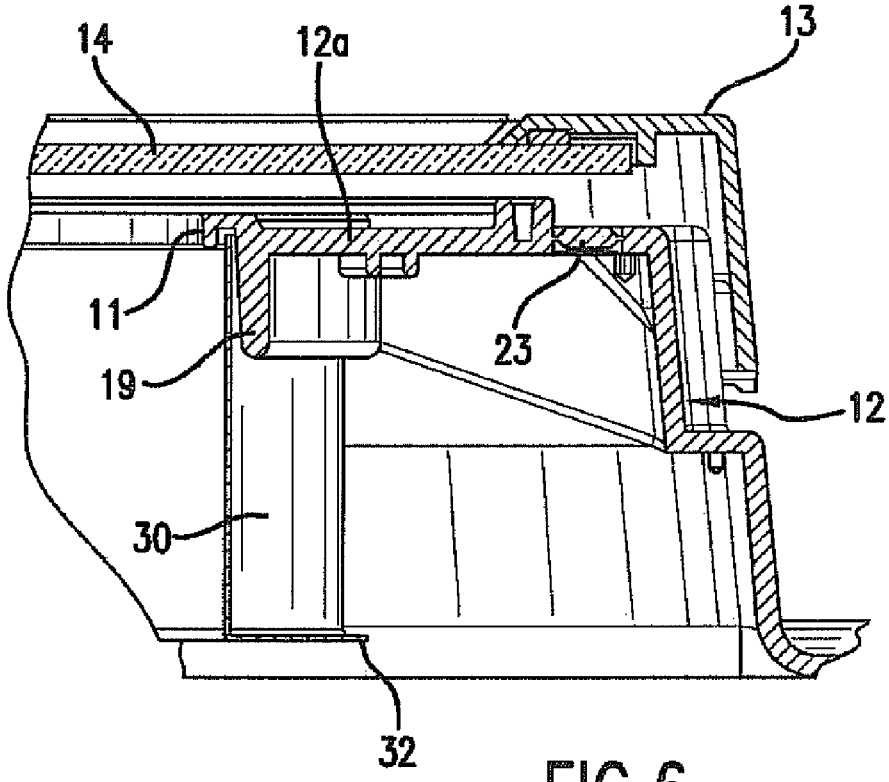
FIG. 6 shows a sectional view ef of the detail shown in FIG. 5.

Referring now to FIGS. 5 and 6, a ring 30 is provided for connection with a rim 19 surrounding the aperture 11 in the frame 12. In the vicinity of one edge of the ring 30, a plurality of pins 31 are distributed over the circumference of the ring for engagement with lugs 20 on the rim 19. By positioning the pins 31 in front of a keyhole-shaped track 21 in each lug 20 and then rotating the ring 30 slightly, a safe engagement between the ring 30 and the frame 12 is obtained. Subsequently, the light conduit 70 is attached to the ring 30 by first guiding one end of light conduit 70 past a circumferential flange 32 at the other edge of the ring 30, and then secure the light conduit 70 to the ring 30 and thus in turn to the frame 12 by means of a draw-band (not shown) positioned above the flange 32. It is noted that the ring may be made integral with the frame, or dispensed with altogether, the connection thus being carried out in any suitable manner. In the embodiment shown, the light conduit thus extends substantially perpendicularly to and almost up to the glazing 14 near the roof unit 10. This provides for an optimum influx of light. A small spacing between the light conduit, or in this case the ring, is left up to the glazing in order to avoid condensation.

Figure 7:
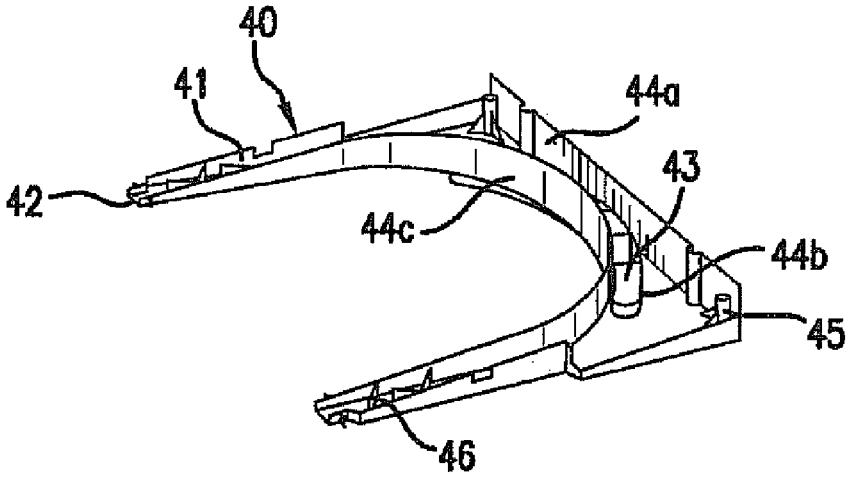
FIGS. 7 and 8 show perspective views of a detail of the embodiment of the roof light system shown in FIGS. 1 and 2.
Figure 8:
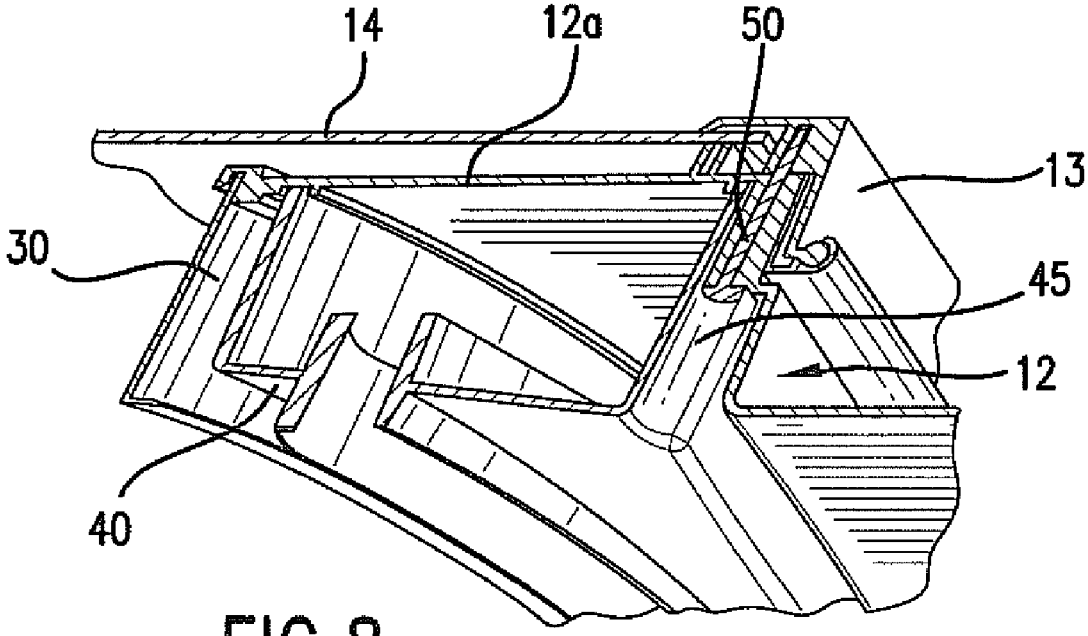
Figure 9:
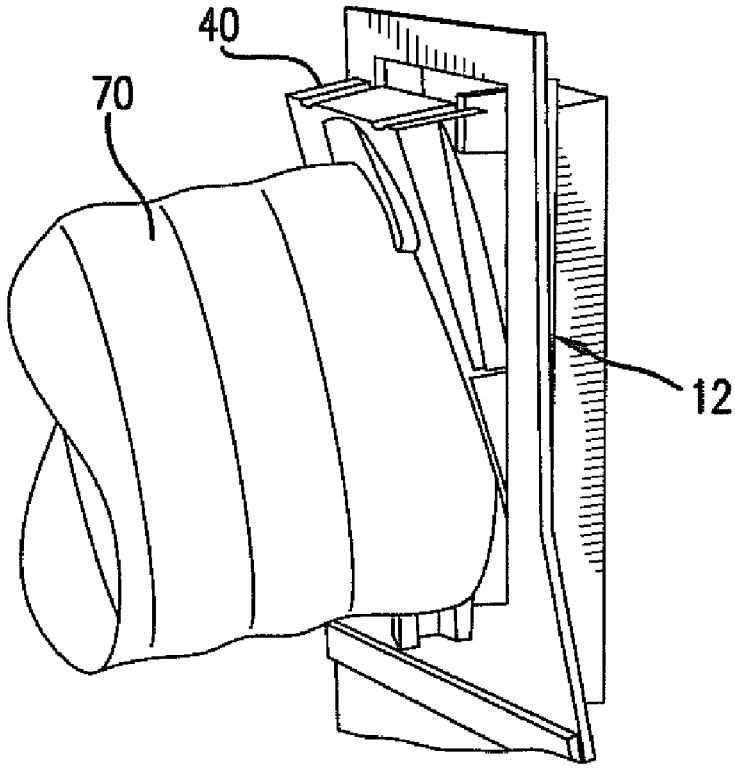
FIG. 9 shows a partial perspective view of the roof light system shown in FIGS. 1 and 2 during installation.

When the light conduit 70 has thus been connected with the roof unit 10, a manifold member 40 shown in detail in FIGS. 7 and 8 is connected with the roof unit 10. The manifold member 40 is mainly U-shaped and at the ends of legs 41, engagement means in the form of protruding flaps 42 are provided. These flaps 42 are inserted into corresponding apertures in the frame 12. In the embodiment shown, these openings are provided by detaching two knock-out plates 22 at the bottom of the frame 12, cf. FIG. 10, from the remaining portion of the frame 12 by an appropriate tool. The position shown in FIG. 9 has now been attained. Manifold member 40 is then swung around flaps 42 at the end of legs 41 until the bottom of the U-shape is brought into abutment with the under side of the upper part of the frame 12. Appropriate fastening means, such as screws 50, are then inserted through upstanding reception elements 45 and further into the frame 12, cf. FIG. 8. The manifold member 40 may be connected with the frame in other ways than that described in the above, including screw fastening, fastening by adhesion, interlocking elements, snap connection etc.

The manifold member 40 could have one of a variety of designs. One possibility is to form the manifold member integral with the frame 12. In its simplest form, the manifold member is constituted by a socket piece connected with the roof unit. The socket piece may e.g. be provided with knock-out plates which are detached when the ventilation device is to be installed. The manifold member may also provide for connection of more than one mouth piece, e.g. one mouth piece for each of the ventilation tube and the branch tube or tubes. Mouth pieces having one opening in the end facing the manifold member and two or more openings in the opposite end are also conceivable, i.e. one opening for each of the ventilation tube and the branch tube or tubes. The openings not in use may be covered by knock-out plates.

The ventilation tube 60 is then connected with the manifold member 40 by means of its mouth piece 61. This connection is not shown in detail but may be carried out in any suitable manner, e.g. by snap engagement or screws. The position shown in FIG. 2 is now attained.

Ventilation of the inner room is performed by means of the following features in the manifold member 40 and the roof unit 10: At the bottom of the U-shape of manifold member 40, a series of arc-shaped openings 43 surrounded by walls 44*b* is provided. Air flowing to or from the ventilation tube 60 is allowed to pass through these openings 43. The manifold member 40 is in fluid communication with the outside by means of a plurality of apertures in the frame 12. As is the case with the flap receiving apertures, such apertures may be obtained by detaching knock-out plates 23 in the frame 12 from the remaining part of the frame, cf. FIGS. 6 and 10. In the installed condition of the roof light system, the sash 13 and the frame 12 form a kind of labyrinth seal, which allows air to escape from and enter into the ventilation tube, but which at the same time makes it difficult for precipitation to enter into the manifold and possibly the ventilation tube. In case precipitation nevertheless enters the manifold member 40, or in case condensation is formed, a controlled drainage is provided, as water collected in the trough defined by outer walls 44*a* and 44*c* and upstanding walls 44*b* surrounding openings 43 may flow out of the frame 12 through the apertures receiving flaps 42. Upstanding wall sections 44*b* prevent flow of water into the ventilation tube 60. Upstanding wall sections 46 form a labyrinth seal in order to secure that precipitation that might have entered the manifold member 40 through these apertures does not flow in the opposite direction.

The respective shape of the frame 12 and the sash 13 may be arbitrary and is traditionally chosen to match possible other roof penetrating structures, such as skylights and roof windows, installed in the roof. In the embodiment shown in the drawings, the frame 12 and sash 13 have a substantially square shape, but other shapes, such as polygonal, e.g. a rectangular shape other than square, circular, oval or any other shape, are conceivable as well. As a consequence of the square shape of the frame 12 and sash 13 in combination with the circular cross-section of the light conduit 70 in the preferred embodiment, an area 12*a* exists between the aperture 11 and the frame 12. This area 12*a* may be utilized for positioning solar cells, preferably connected to battery means, to provide energy for e.g. a screening arrangement in the form of a dimmer situated in the roof light system, or possibly even for controlling or operating a drive motor of en electrically operated fan. Such solar cells may of course also be positioned on other places of the roof unit. For instance, the glazing may be covered by solar cells, in articular in the section corresponding to the area 12*a* of the frame, e.g. on the inner side of the glazing. The area 12*a* may have a coloured and/or reflective film or coating in order to obtain a uniform appearance of the roof unit. Such film or coating may also be provided on the glazing 14.

The roof light system may be provided as a base module comprising roof unit, light conduit, diffuser, and, in the present invention, ventilation device. However, parts of the base module may be exchanged or supplemented. For instance, the light conduit may be customized for e.g. very long or complicated routing through the roof structure. Furthermore, the roof light system may be modified into a traditional openable window. This modification is carried out in the following manner, referring in particular to FIGS. 10 and 11:

Light conduit 70 is removed substantially in reverse manner in relation to the installation operation as described in the above.

Sash 13 is removed from the frame 12. In the state of delivery of the roof light system, the sash 13 is advantageously connected with the frame 12 by means of a hinge connection at the top of the sash 13 and frame 12. When the roof light system is in use, the sash 13 is most often secured to the frame by means of screws or similar fastening means to prevent the sash 13 from being opened inadvertently. Hinge connection may, however, be provided separately.

The area 12*a* surrounding the aperture 11 in the frame 12 is detached from the remaining part of the frame 12. The detachment is facilitated by detachment indication lines 24. Detachment indication lines 24 may be provided by means of visual indication only, or as weakening lines.

Figure 11:
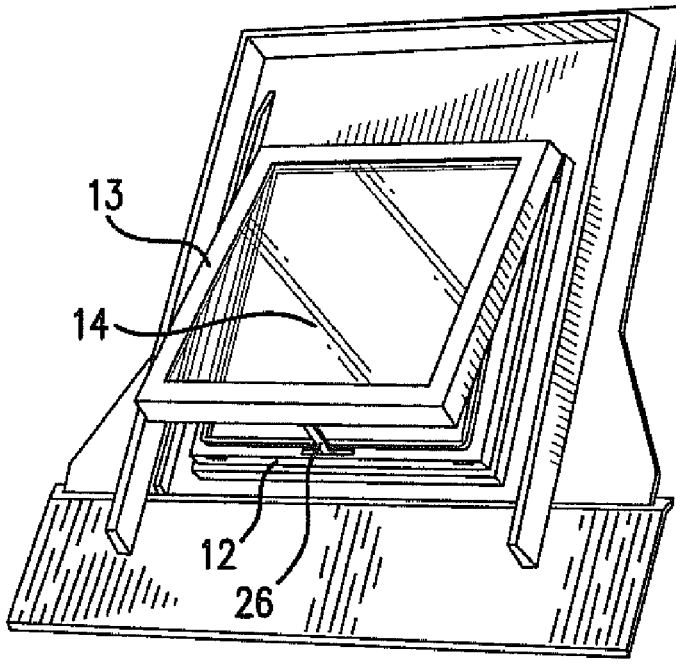
FIG. 11 is a view corresponding to FIG. 10 of an alternative embodiment of the roof light system according to the present invention.

An aperture at the bottom of the frame 12 is obtained by means of a knock-out plate 25, the function of which is apparent from FIG. 11, viz. to accommodate the passage of an extending device, e.g. in the form or a stay 26.

Sash 13 is re-connected with the frame 12, possibly after the application of a hinge connection, and the extending device 26 is attached to the sash 13 and cooperating fixture means to the frame 12. Such extending devices, fixtures and other kinds of operating devices, e.g. an electrically operated chain, are known per se and are not the subject of detailed description. It is of course conceivable to exchange the sash 13 of the base module with any other kind of sash, e.g. a sash having a different glazing with respect to colour, translucency or shape. For instance, the glazing may be substantially dome-shaped.

The diffuser unit 80 depends from the light conduit of the roof light system described above, and transmits light received from the light conduit into the interior of the building room. The diffuser unit may take many different forms and is as such not a central part of the present invention. In the following an embodiment of the diffuser unit corresponding to the embodiment of FIG. 4 will be described.

The diffuser unit includes a ceiling ring, a dual diffuser, a trim ring, a ceiling ring gasket, and a diffuser gasket.

Figure 12:
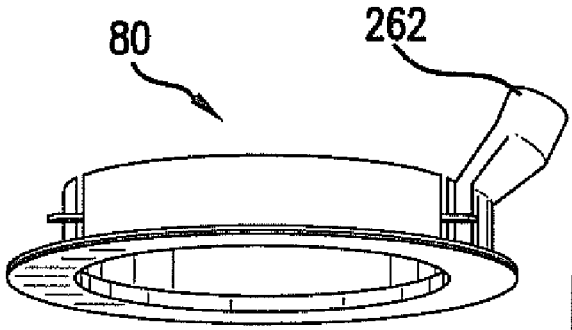
FIG. 12 shows a perspective view of a detail of the roof light system according to the invention.
Figure 13:
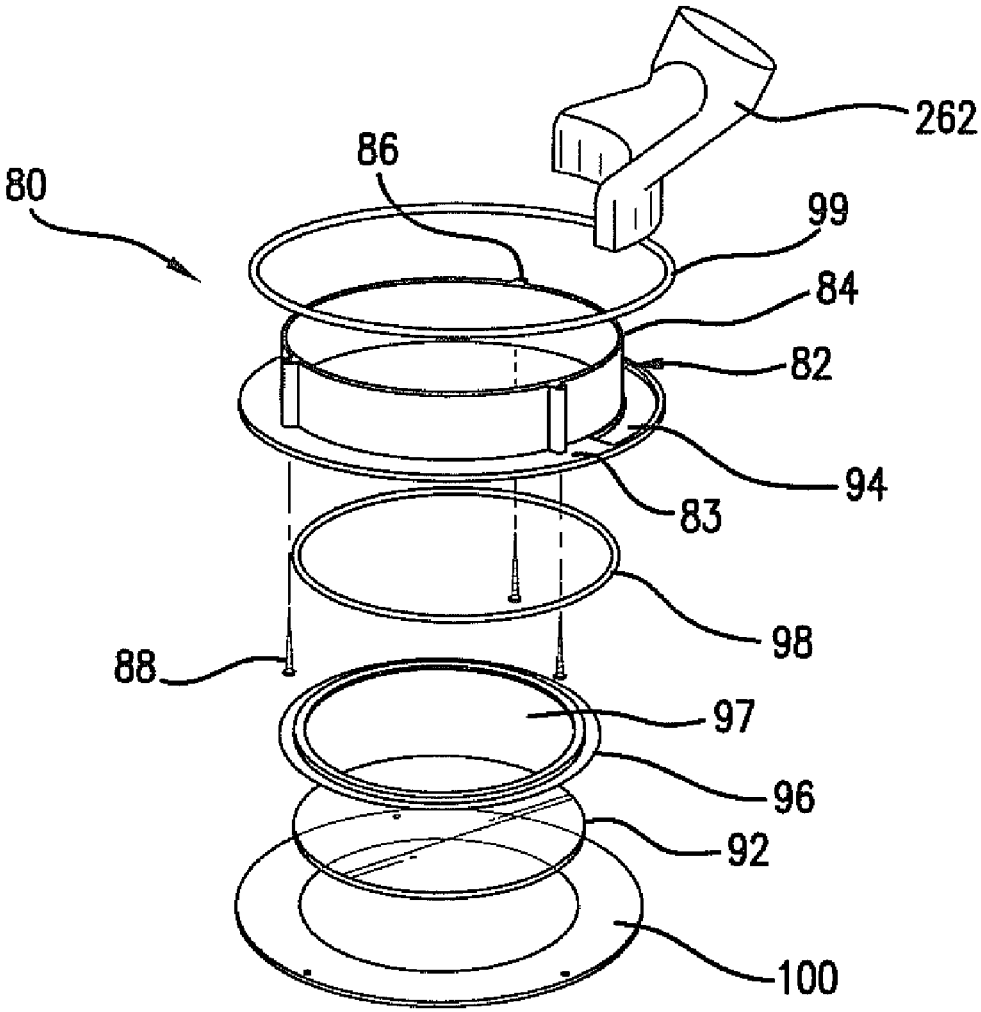
FIG. 13 is an exploded perspective view of the detail of FIG. 12.

With reference to FIGS. 12 and 13, diffuser unit 80 is depicted. Ceiling ring 82 includes a plurality of flanges 84 configured for receipt of the light conduit from the roof light system. As will be appreciated, flanges 84 are configured for mating attachment with the distal end of the light conduit, whether the light conduit is constructed of a flexible tube or of a solid member. The light conduit may be attached to the flanges 84 by screws, banding attachment, or the like.

It will be observed in FIG. 13 that gasket 99 is also provided. Gasket 99 is disposed for receipt above flange 83 of ceiling ring 82, to provide a seal between flange 83 and gypsum, sheetrock, or like ceiling material upon installation of the diffuser unit in a building.

Ceiling ring 82 also includes a plurality of adjustable mounting cams 86. Mounting cams 86 are activated by screws 88, the heads of which are accessible from beneath ceiling ring 82. By turning screws 88, mounting cams 86 are drawn downward, with the gypsum boards, sheetrock, or like material by which the interior room ceiling is constructed disposed between mounting cams 86 and flange 83, thereby attaching ceiling ring 82 to the ceiling.

Each screw 88 also includes at its head a mounting tab (not shown in detail). Mounting tabs are configured to swing about the head of screws 88 to allow for receipt and attachment of the diffuser unit 92.

As depicted in FIG. 13, diffuser unit 80 includes flange 83 about the exterior. Flange 83 is configured for co-planar disposition against the interior ceiling of a building. As noted in FIG. 13, flange 83 also includes a plurality of apertures 94. Apertures 94 are configured for receipt of the second branch tube 260 of the roof light system. The apertures 94 are advantageously provided by detaching knock-out plates, as has been described in further detail with respect to other parts of the roof light system. When installing the ventilation device, mouth piece 262, which constitutes a manifold member having at least one opening to form a fluid communication with the second branch tube 260, is connected with the diffuser unit 80 in any suitable manner. It will be appreciated that, by engagement of such a ventilation tube with apertures 94 upon ceiling ring 82, only two further penetrations of an interior building ceiling would be necessary for installation of both a roof light system as well as a roof ventilation system providing ventilation in three different, spaced-apart areas.

Diffuser unit 80 also includes diffuser pan 96 and diffuser 92. Diffuser pan 96 is configured to slide within the interior opening defined within ceiling ring 82. Likewise, diffuser 92 is configured for fitting within the aperture defined within ceiling ring 82. Diffuser pan 96 receives diffuser 92 so as to allow a space of air between diffuser 92 and the pane 97 of diffuser pan 96. So disposed, the combination of diffuser pan 96 and diffuser 92 creates a thermal barrier to the transmission of heat to or from the roof light system. Once diffuser pan 96 and diffuser pan 92 are installed within the aperture defined through the center of ceiling ring 82, mounting tabs are swung into position to hold diffuser 92, and thus also diffuser pan 96, within ceiling ring 82, blocking their removal. Disposed above diffuser pan 96 is gasket 98, providing a seal of the roof light system against the intrusion of humidity, dust, and insects to the interior of the roof light system.

Finally provided is trim ring 100, adapted for a snap fit engagement with ceiling ring 82. Trim ring 100 provides a finished outward surface for diffuser unit 80 upon installation of diffuser unit 80 into a ceiling.

So configured, installation of diffuser unit 80 into a building may proceed as follows. Upon installation of a roof unit in accordance with the present invention, an aperture may be cut through a ceiling of a building of appropriate size for receipt of diffuser unit 80. With gasket 99 in place about ceiling ring 82 above flange 83, ceiling ring 82 and gasket 99 may be inserted through such hole. So inserted, screws 88 are then turned so as to engage mounting cams 86, so as to capture between mounting cams 86 and flange 83 the ceiling gypsum board, sheetrock, or the like, thereby attaching ceiling ring 82 into the ceiling. The light conduit may then be attached to flanges 84. In the embodiment shown in FIGS. 12 and 13, the second branch tube 260 is attached to apertures 94 by means of mouth piece 262 constituting a manifold member as described in the above. Gasket 98 may then be installed within the aperture defined within ceiling ring 82. With gasket 98 in place, diffuser pan 96 and diffuser 92 may be installed within the aperture of ceiling ring 82, with mounting tabs then turned to hold diffuser 92 within ceiling ring 82 against gravity. The trim ring 100 may then be installed over the exposed flange 83 of ceiling ring 82, snap fitted into place.

The invention should not be regarded as being limited to the embodiments shown and described in the above. Various modifications and combinations may be carried out without departing from the scope of the appended claims.

The invention claimed is:

1. A roof light system, comprising:

a roof unit;

a diffuser unit;

a light conduit, said light conduit including a first cross-section and a first length and extending between said roof unit and said diffuser unit;

said roof light system further including a ventilation tube, said ventilation tube having a first end and a second end, a second length extending between said first end and said second end, and a second cross-section, said second cross-section being detached from said first cross-section, said first end of said ventilation tube connected with said roof unit, and said second end disposed apart from said diffuser unit; and said light conduit disposed outboard of said ventilation tube.

2. The roof light system of claim 1, further including a first branch tube extending between a third end and a fourth end.

3. The roof light system of claim 2, wherein said fourth end is disposed apart from said second end of said ventilation tube and is disposed apart from said diffuser unit.

4. The roof light system of claim 2, further including a second branch tube extending between a fifth end and a sixth end.

5. The roof light system of claim 4, wherein said sixth end of said second branch tube is connected with said diffuser unit.

6. The roof light system of claim 1, further including a manifold member, said manifold member connecting said ventilation tube to said roof unit.

7. The roof light system of claim 6, wherein said roof unit includes a frame, a sash, and a glazing, said glazing carried by said sash; and said manifold member is connected with said frame.

8. A roof light system, comprising:

a roof unit, said roof unit including a frame, a sash, and a glazing, said glazing carried by said sash;

a diffuser unit;

a light conduit, said light conduit including a first cross-section and a first length and extending between said roof unit and said diffuser unit;

a ventilation tube, said ventilation tube having a first end and a second end, a second length extending between said first end and said second end, and a second cross-section, said second cross-section being detached from said first cross-section, said first end of said ventilation tube connected with said roof unit, and said second end disposed apart from said diffuser unit; and a manifold member, said manifold member connecting said ventilation tube to said roof unit, said manifold member connected with said frame, said manifold member being substantially U-shaped and partially surrounding said light conduit.

9. The roof light system of claim 5, further including a manifold member, said manifold member connecting said sixth end of said second branch tube with said diffuser unit.

10. The roof light system of claim 7, wherein said manifold member includes a releasable engagement for connecting said manifold member to said roof unit;

said roof unit including manifold receiving means; and said releasable engagement configured for cooperation with said manifold receiving means.

11. A roof light system, comprising:

a roof unit, said roof unit including a frame, a sash, a glazing, and manifold receiving means, said glazing carried by said sash;

a diffuser unit;

a light conduit, said light conduit including a first cross-section and a first length and extending between said roof unit and said diffuser unit;

a ventilation tube, said ventilation tube having a first end and a second end, a second length extending between said first end and said second end, and a second cross-section, said second cross-section being detached from said first cross-section, said first end of said ventilation tube connected with said roof unit, and said second end disposed apart from said diffuser unit;

a manifold member, said manifold member connecting said ventilation tube to said roof unit and including a releasable engagement for connecting said manifold member to said roof unit and configured for cooperation with said manifold receiving means; and wherein said manifold receiving means are knock-out plates defined by detachment indication lines.

12. The roof light system of claim 11, further including supplemental connection means for attaching said manifold member to said roof unit.

13. The roof light system of claim 6, wherein said manifold member defines a plurality of openings, said openings surrounded by walls.

14. The roof light system of claim 1, further including means for mechanical ventilation.

15. The roof light system of claim 1, further including a plurality of solar cells in electrical communication with said roof unit.

16. The roof light system of claim 7, wherein light reflective lining is provided upon one of said frame, said glazing, and said frame and said glazing.

17. The roof light system of claim 1, further including:

a frame defining a circular aperture therein, and a sash, said frame and sash each being rectangular in cross-section.

18. A roof light system, comprising:

a roof unit;

a diffuser unit;

a frame defining a circular aperture therein;

a rim surrounding said aperture, said rim including lugs;

a ring, said ring connected to said rim, said ring including pins engaged with said lugs;

a sash;

said frame and sash each being rectangular in cross-section;

a light conduit, said light conduit including a first cross-section and a first length and extending between said roof unit and said diffuser unit;

a ventilation tube, said ventilation tube having a first end and a second end, a second length extending between said first end and said second end, and a second cross-section, said second cross-section being detached from said first cross-section, said first end of said ventilation tube connected with said roof unit, and said second end disposed apart from said diffuser unit.

19. The roof light system of claim 18, wherein:

said ring includes a circumferential flange;

a draw-band; and said light conduit connected with said ring by said draw-band positioned above said circumferential flange.

* * * * *